US011242826B2

(12) United States Patent
Park et al.

(10) Patent No.: US 11,242,826 B2
(45) Date of Patent: Feb. 8, 2022

(54) INTAKE MANIFOLD AND RUNNER STRUCTURE THEREOF

(71) Applicant: HYUNDAI KEFICO CORPORATION, Gunpo-si (KR)

(72) Inventors: Jin Kyu Park, Gyeonggi-do (KR); Dong June Kim, Daegu (KR); Chan Ka Ram Na, Gyeonggi-do (KR)

(73) Assignee: HYUNDAI KEFICO CORPORATION, Gyeonggi-do (KR)

( * ) Notice: Subject to any disclaimer, the term of this patent is extended or adjusted under 35 U.S.C. 154(b) by 0 days.

(21) Appl. No.: 16/997,507

(22) Filed: Aug. 19, 2020

(65) Prior Publication Data

US 2021/0088012 A1 Mar. 25, 2021

(30) Foreign Application Priority Data

Sep. 23, 2019 (KR) ..... 10-2019-0116550

(51) Int. Cl.
*F02M 35/10* (2006.01)
*F02M 35/104* (2006.01)

(52) U.S. Cl.
CPC .... *F02M 35/10032* (2013.01); *F02M 35/104* (2013.01); *F02M 35/10072* (2013.01); *F02M 35/10288* (2013.01)

(58) Field of Classification Search
CPC ..... F02M 35/10032; F02M 35/10072; F02M 35/10288; F02M 35/104; F02M 35/12; F02M 35/10
See application file for complete search history.

(56) References Cited

U.S. PATENT DOCUMENTS

| | | | | |
|---|---|---|---|---|
| 5,762,036 | A * | 6/1998 | Verkleeren | F02M 35/10039 123/184.31 |
| 10,443,550 | B2 * | 10/2019 | Zouani | F02M 35/104 |
| 2011/0005488 | A1 * | 1/2011 | Reese | F02M 35/116 123/184.61 |
| 2017/0175688 | A1 | 6/2017 | Nola et al. | |

FOREIGN PATENT DOCUMENTS

| | | | |
|---|---|---|---|
| JP | 2012041870 | * | 8/2010 |
| JP | 2012-041870 | A | 3/2012 |
| JP | 5078558 | B2 | 11/2012 |
| JP | 5282408 | B2 | 9/2013 |
| KR | 10-1996-0034705 | | 10/1996 |
| KR | 20-1998-0039963 | A | 9/1998 |
| KR | 20-1999-0030471 | A | 7/1999 |
| KR | 10-2005-0120867 | A | 12/2005 |
| KR | 10-2010-0001735 | A | 1/2010 |

* cited by examiner

*Primary Examiner* — Syed O Hasan
(74) *Attorney, Agent, or Firm* — Mintz Levin Cohn Ferris Glovsky and Popeo, P.C.; Peter F. Corless

(57) ABSTRACT

An intake manifold is provided and includes a runner that is connected between a plenum and a cylinder head to allow air introduced into the plenum to enter the cylinder head. A dent is formed at the runner such that the dent extends along a channel of the runner while having an inner surface with a protruding shape. The runner has, at an end thereof, an inner surface formed to be flat without being formed with the dent. The inner surface of the runner is connected to the cylinder head.

15 Claims, 12 Drawing Sheets

INTAKE MANIFOLD AND RUNNER STRUCTURE THEREOF

CROSS-REFERENCE TO RELATED APPLICATION

This application claims priority from Korean Patent Application No. 10-2019-0116550, filed on Sep. 23, 2019, the disclosure of which is incorporated herein by reference in its entirety.

BACKGROUND

1. Field of the Disclosure

The present disclosure relates to an intake manifold advantageous in rigidity and reduction of stress and noise through structural improvement thereof, and a runner structure thereof.

2. Description of the Related Art

An air fuel module system (AFMS) of a vehicle covers an intake manifold, a fuel rail system, energy management system (EMS) components, a wire harness, a throttle body, etc. The AFMS is modularized with a substantial number of EMS components. An intake manifold, which is a core of the intake system, is a distribution tube that extends from a throttle body to intake ports of cylinders. The intake manifold guides a mixture of air and fuel to be supplied to the interiors of the cylinders during an intake stroke.

The intake manifold is an important element having direct influence on determination of performance of an engine among constituent elements of a vehicle. Accordingly, conventionally, technology for reducing vibration and noise through addition of a structure to the intake manifold has been proposed. However, there is an increase in the weight of the intake manifold. Furthermore, there is no remarkable advantage in terms of vibration and noise. Therefore, an intake manifold having a new structure capable of eliminating drawbacks in conventional cases, and also solving vibration and noise problems, is required.

The above matters disclosed in this section are merely for enhancement of understanding of the general background of the disclosure and should not be taken as an acknowledgement or any form of suggestion that the matters form the related art already known to a person skilled in the art.

SUMMARY

Therefore, the present disclosure provides an intake manifold advantageous in rigidity and reduction of stress and noise through a structural improvement thereof, and a runner structure thereof.

In accordance with an aspect of the present disclosure, the above and other objects may be accomplished by the provision of an intake manifold that may include a runner connected between a plenum and a cylinder head to allow air introduced into the plenum to enter the cylinder head, and a dent formed at the runner and that extends along a channel of the runner while having an inner surface with a protruding shape. The runner includes, at an end thereof, an inner surface formed to be flat without being formed with the dent, and the inner surface of the runner may be connected to the cylinder head.

The runner may be formed to have a shape bent in a longitudinal direction thereof to have a predetermined curvature at an intermediate portion thereof. The dent may be formed along an inner surface of the runner directed outwards with reference to the channel of the runner. Further, the runner may be formed to have a quadrangular tube structure with a closed cross-sectional shape. The runner may have a cross-sectional area that gradually decreases as the runner extends from a first end thereof joined to the plenum to a second end thereof joined to the cylinder head. The dent may be centrally formed at an inner surface of the runner disposed at one side of an overall peripheral inner surface of the runner forming a tubular shape of the runner.

According to another embodiment, the runner may be formed to have a rectangular tube shape in which a lateral width thereof is greater than a vertical height thereof. The dent may be formed with a lateral width thereof greater than a vertical height thereof, and may be formed at one inner surface of the runner extending laterally to have the lateral width. The height of the dent and the width of the dent may be determined to have a length ratio of 1:5 to 30. The width of the dent and the width of the runner may be determined to have a ratio of 1:2.5 to 3. The height of the dent and the height of the runner may be determined to have a ratio of 1:40 to 30.

An outer surface of the runner formed with the dent may be formed to have a groove shape that corresponds to the outer surface of the dent. The dent may be formed such that the protruding shape thereof gradually decreases toward the end of the runner in a predetermined section of the runner including the end of the runner. Additionally, the runner may include a first section formed to have a tubular structure with a curved shape having a predetermined curvature, and connected to an outlet of the plenum at a first end thereof, and a second section formed to have a linear tubular shape, and joined to a second end of the first section at a first end thereof while being connected to a port of the cylinder head at a second end thereof.

The dent may include a uniformly-shaped dent portion formed along an inner surface of the first section to have a uniform cross-section with a predetermined shape, and a variably-shaped dent portion formed along an inner surface of the second section, and connected to the uniformly-shaped dent portion. A first end of the variably-shaped dent portion may be formed to have a shape matched with a cross-section of the uniformly-shaped dent portion, and may be connected to the uniformly-shaped dent portion. The variably-shaped dent portion may have a structure having a cross-section gradually decreasing toward the second end of the variably-shaped dent portion. A flat surface may be formed between the second end of the runner and the second end of the variably-shaped dent portion. The length of the first section and the length of the second section with reference to the channel of the runner may be determined to have a length ratio of 3.1 to 3.3:1.

The intake manifold may be completed through assembly of an upper shell, a center shell, and a lower shell. The upper shell may be assembled to an upper end of the center shell to form the first section of the runner. The lower shell may be assembled to a lower end of the center shell to form the second section of the runner. The uniformly-shaped dent portion of the dent may be formed along a concave inner surface of the upper shell. The variably-shaped dent portion of the dent may be formed along an inner surface of the lower shell assembled to the upper shell at a position joined to the uniformly-shaped dent portion of the dent.

The runner may be connected to an upper surface of the plenum while being arranged in a longitudinal direction of the upper surface of the plenum. The plenum may be formed to have an expanded structure in which opposite lateral surfaces of the plenum protrude outwards at middle portions thereof, respectively.

An inlet may be formed at a first end of the plenum. The plenum may be formed to have a cross-sectional area gradually increasing as the plenum extends from a first end thereof to a middle portion thereof in a longitudinal direction. The plenum may be formed to have a cross-sectional area gradually decreasing as the plenum extends from the middle portion thereof to a second end thereof in the longitudinal direction such that the plenum has a smaller cross-sectional area at the second end thereof than at first end thereof.

In accordance with another aspect of the present disclosure, a runner structure for an intake manifold may be connected between a plenum and a cylinder head to allow air introduced into the plenum to enter the cylinder head. Additionally, a dent may be formed at the runner structure such that the dent extends in a longitudinal direction of the runner structure while having an inner surface with a protruding shape. The runner structure may include, at an end thereof, an inner surface formed to be flat without being formed with the dent, and the inner surface of the runner structure may be connected to the cylinder head.

In accordance with the exemplary embodiment of the present disclosure, the dent may be formed to have a protruding structure at the inner surface of the runner and, as such, flow rate of air passing through the runner may be increased. Accordingly, an enhancement in response characteristics of a vehicle, to which the runner structure according to the exemplary embodiment of the present disclosure is applied, may be achieved. In particular, an increase in intrinsic frequency may be achieved by the dent and, as such, an increase in rigidity of the intake manifold may be achieved. In addition, the maximum stress exhibited in accordance with vibration in 3-axial directions (X-axis, Y-axis, and Z-axis) may be reduced, and noise may be reduced.

BRIEF DESCRIPTION OF THE DRAWINGS

The above and other objects, features and other advantages of the present disclosure will be more clearly understood from the following detailed description taken in conjunction with the accompanying drawings, in which.

DETAILED DESCRIPTION

Figure 1:
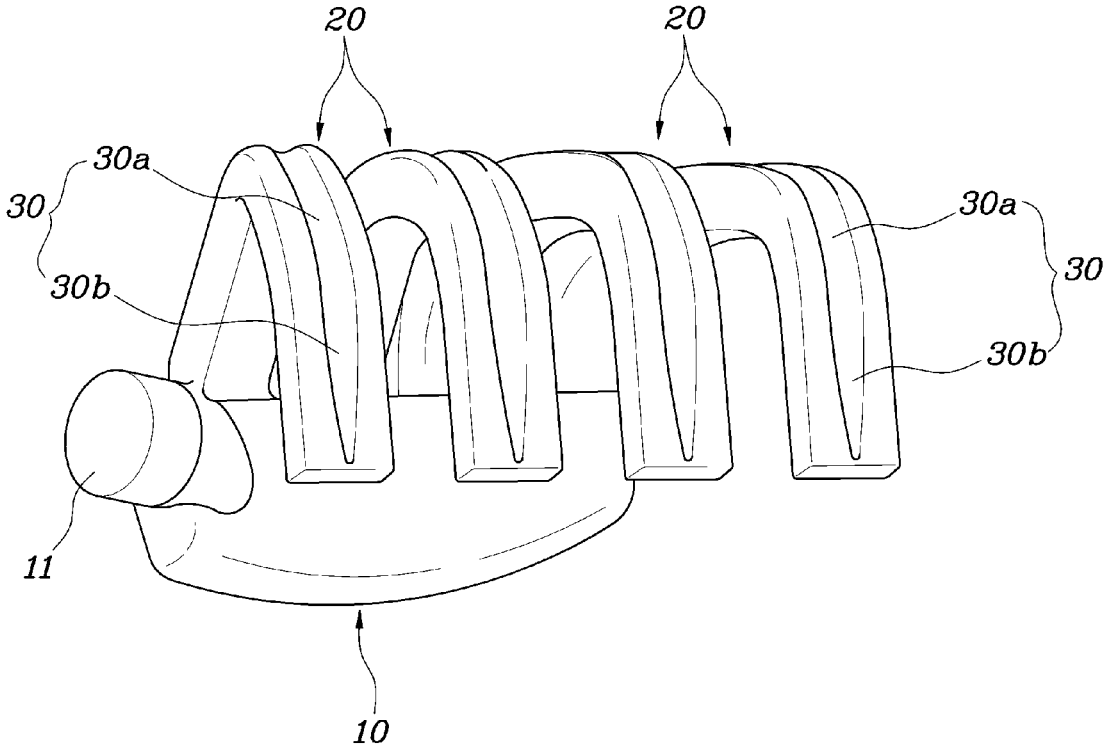
FIG. 1 is a view illustrating an inner structure of an intake manifold according to an exemplary embodiment of the present disclosure in the form of a core.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Reference will now be made in detail to the exemplary embodiments of the present disclosure, examples of which are illustrated in the accompanying drawings. Wherever possible, the same reference numbers will be used throughout the drawings to refer to the same or like parts.

An intake manifold according to an exemplary embodiment of the present disclosure may include a plenum 10 and runners 20. A dent 30 may be formed at each runner 20. The exemplary embodiment of the present disclosure will be described in detail with reference to FIG. 1. Each runner 20 allows air introduced into the plenum 10 to enter a cylinder head 40. Accordingly, each runner 20 may be connected between the plenum 10 and the cylinder head 40.

For example, each runner 20 may be connected, at a first end thereof, to an outlet 12 of the plenum 20 while being connected, at a second end thereof, to a port formed at the cylinder head 40. In addition, the dent 30 may be formed at each runner 20 such that the dent 30 extends along a channel of the runner 20 while having an inner surface that protrudes toward the center of the channel. For example, the configuration of the runner 20 may be applied to all runners 20 formed at the intake manifold.

In accordance with the above-described configuration, since the dent 30 of each runner 20 protrudes from an inner surface of the runner 20, the cross-sectional area of the channel in the runner 20 may be reduced by a protruding cross-sectional area of the dent 30. Accordingly, the flow rate of air passing through the runner 20 may increase and air may be rapidly introduced into the cylinder head 40. Thus, an enhancement in response characteristics may be achieved.

In particular, an increase in intrinsic frequency may be achieved in accordance with formation of the dent 30 and therefore, an increase in rigidity of the intake manifold may be achieved. In addition, the maximum stress exhibited in accordance with vibration in 3-axial directions (X-axis, Y-axis, and Z-axis) may be reduced, and noise may be reduced. Further, an end of each runner 20 to be connected to the cylinder head 40 may be formed with an inner surface to be flat without having the dent 30. For example, the second end of each runner 20 may be connected to the corresponding port of the cylinder head 40, and the inner surface of the end of the runner 20 connected to the port may be formed to be flat and thus, a flat portion thereof may be joined to an inner surface of the port. Accordingly, air may more naturally and stably flow in an area where the runner 20 is joined to the port of the cylinder head 40, and may then enter a cylinder.

Hereinafter, the position of the dent 30 formed at each runner 20 will be described with reference to FIGS. 1 to 3. The runner 20 may be formed to have a shape bent in a longitudinal direction thereof to have a predetermined curvature at an intermediate portion thereof. In addition, the dent 30 may be formed along an inner surface of the runner 20 directed outwards with reference to the channel of the runner 20. In other words, the dent 30 may be formed at an inner surface of the runner 20 disposed outwards when viewed in a direction of air flowing through the channel of the runner 20.

Figure 4:
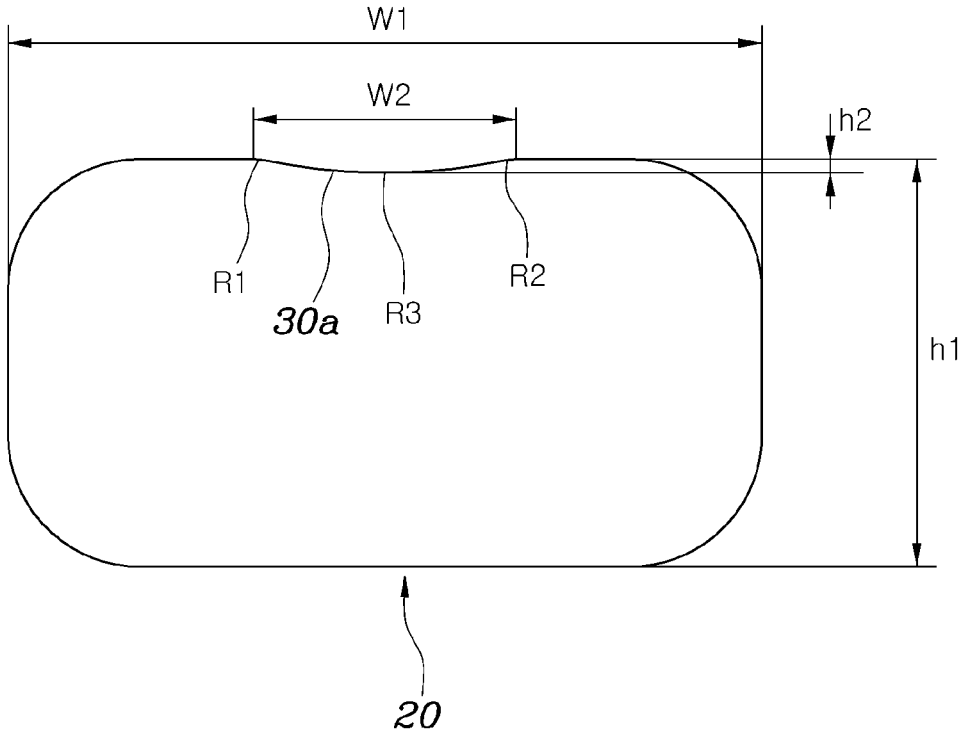
FIG. 4 is a cross-sectional view taken along line A-A' in FIG. 3, illustrating a cross-sectional shape of a dent formed at a first section of a runner according to an exemplary embodiment of the present disclosure.

In addition, referring to FIG. 4, each runner 20 may be formed to have a quadrangular tube structure with a closed cross-sectional shape such that the runner 20 has a cross-sectional area gradually decreasing as the runner 20 extends from a first end thereof joined to the plenum 10 to a second end thereof joined to the cylinder head 40. Furthermore, the dent 30 may be centrally formed at an inner surface of the runner 20 disposed at a first side of the overall peripheral inner surface of the runner 20. The overall peripheral inner surface of the runner 20 may form a tubular shape.

For example, as the inner surface of each runner 20 is formed to have a quadrangular cross-sectional shape, and the cross-sectional area of the runner 20 is gradually reduced toward the cylinder head 40, flow rate of air flowing along the runner 20 may increase and, as such, air may enter the cylinder head 40 more rapidly. The shapes of each runner 20 and the dent 30 thereof will be described in more detail with reference to the accompanying drawings. The runner 20 may be formed to have a rectangular tube shape in which a lateral width w1 thereof is greater than a vertical height h1 thereof.

In addition, the dent 30 may be formed such that a lateral width w2 thereof is greater than a vertical height h2 thereof, and may be formed at one inner surface of the runner 20 extending laterally to have the lateral width w1. In particular, opposite inner surface portions of the runner 20 respectively forming boundaries with respect to the dent 30 may be formed to be round and therefore, boundary portions of the inner surface in the runner 20 may be formed to be smooth. In addition, a protruding portion of the dent 30 centrally disposed at the dent 30 may be formed to be round. Furthermore, each corner portion of the overall peripheral inner surface of the runner 20 may be formed to be round.

In other words, the dent 30 may be formed at the inner surface of the runner 20 while having a smoothly protruding structure in which the length in the width direction thereof is greater than the length in the height direction thereof, and boundary portions (e.g., edge portions) of the dent 30 may also be formed to be round. Accordingly, the dent 30 may be formed at the runner 20 without adversely affecting flow of air. In addition, the height h2 of the dent 30 and the width w2 of the dent 30 may be determined to have a length ratio of 1:5 to 30.

Figure 5A:
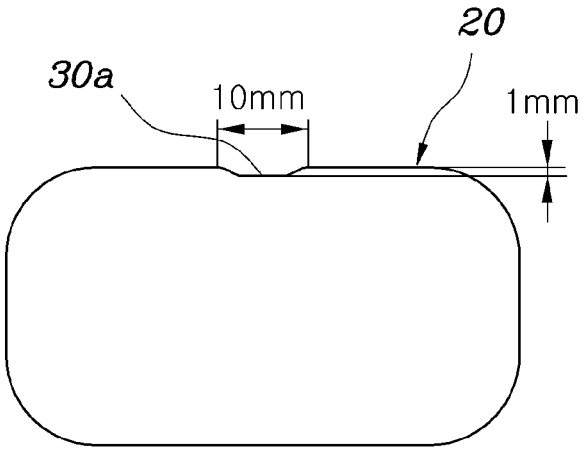
FIGS. 5A-5F are views respectively illustrating structures of a dent portion formed at the first section of the runner according to exemplary embodiments of the present disclosure.
Figure 5B:
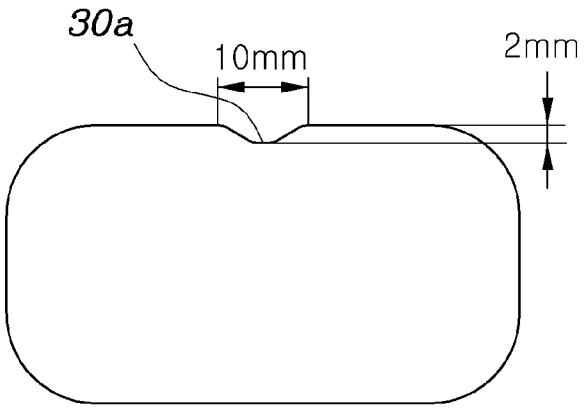

FIGS. 5A-5F illustrate a configuration of an exemplary embodiment of the dent 30. When the dent 30 is formed with the height h2 thereof as about 1 mm, as illustrated in FIG. 5A, the dent 30 may be formed to have a width w2 of about 10 mm. On the other hand, when the dent 30 is formed with a height h2 as about 2 mm, as illustrated in FIG. 5B, the dent 30 may be formed to have a width w2 of about 10 mm.

Figure 5C:
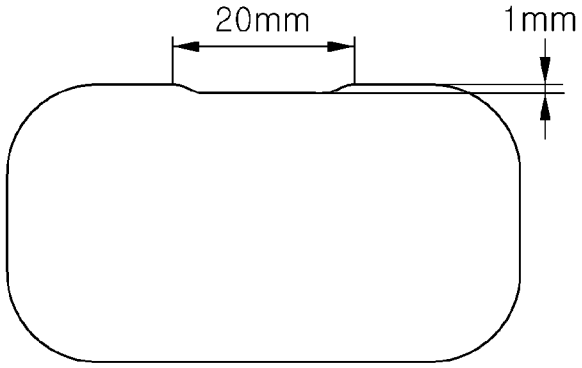
Figure 5D:
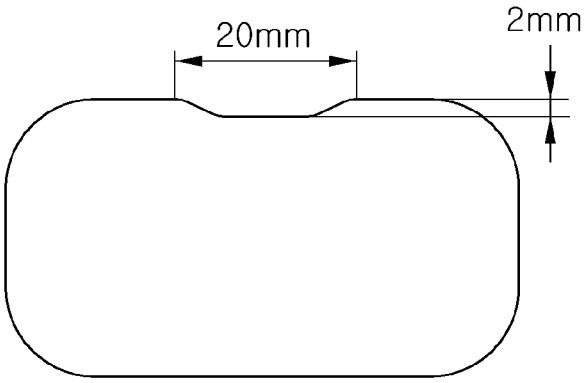
Figure 5E:
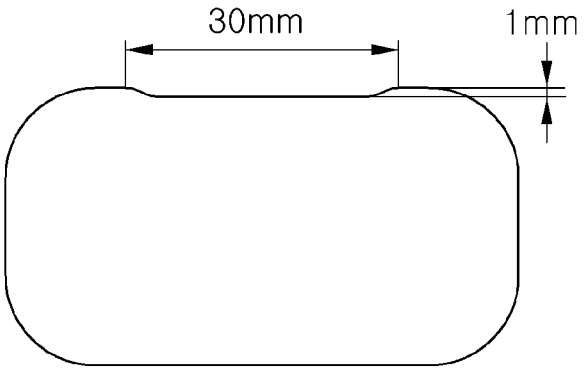
Figure 5F:
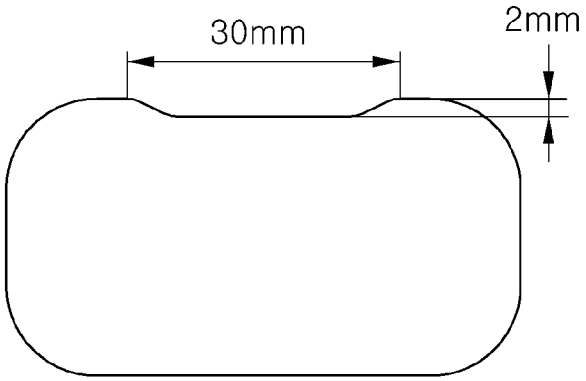

Additionally, when the dent 30 is formed with a height h2 of about 1 mm, as illustrated in FIG. 5C, the dent 30 may be formed to have a width w2 of about 20 mm. On the other hand, when the dent 30 is formed with a height h2 of about 2 mm, as illustrated in FIG. 5D, the dent 30 may be formed to have a width w2 of about 20 mm. In addition, when the dent 30 is formed with a height h2 of about 1 mm, as illustrated in FIG. 5E, the dent 30 may be formed to have a width w2 of about 30 mm. On the other hand, when the dent 30 is formed with a height h2 of about 2 mm, as illustrated in FIG. 5F, the dent 30 may be formed to have a width w2 of about 30 mm.

Figure 10:
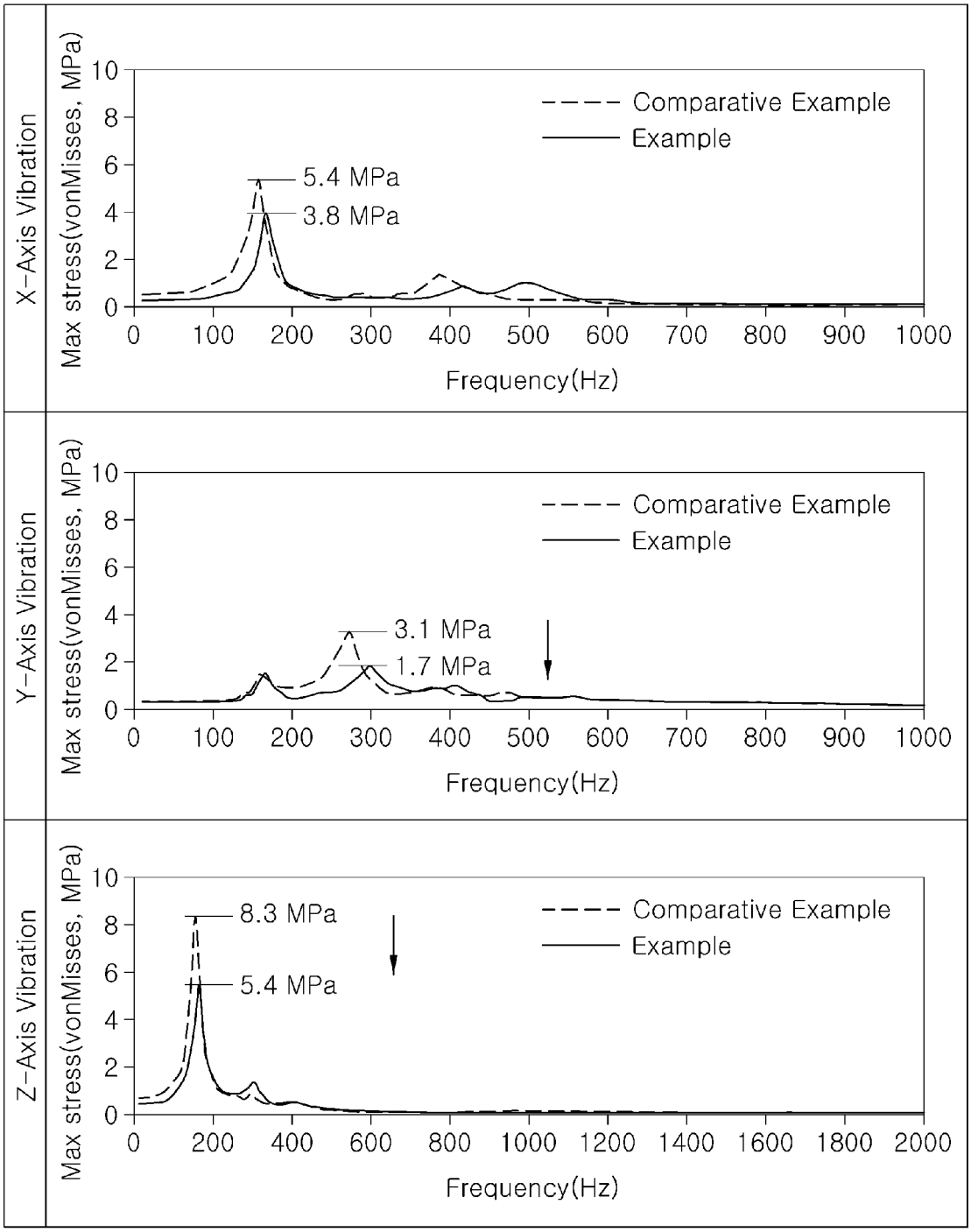
FIG. 10 show experimental results of stress variation exhibited in accordance with frequency variation in an example in which a dent is formed in accordance with the exemplary embodiment of the present disclosure and a comparative example in which there is no dent.
Figure 11:
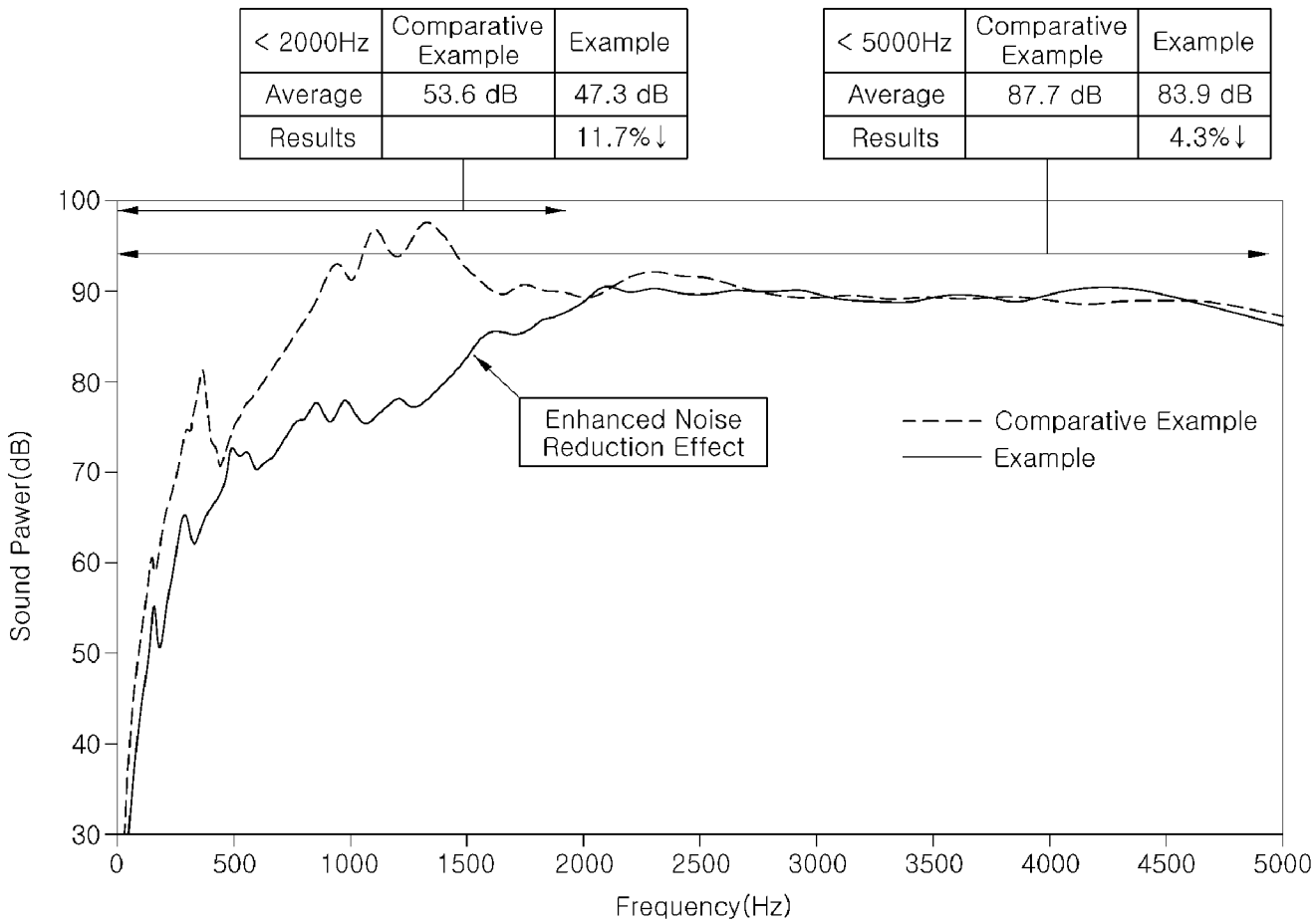
FIG. 11 show experimental results of noise variation exhibited in accordance with frequency variation in the example in which the dent is formed in accordance with the exemplary embodiment of the present disclosure and the comparative example in which there is no dent.

For reference, the height h2 and the width w2 of the dent 30 may be applied to a uniformly-shaped dent portion 30*a* in a first section 20*a* (L1) of the dent 30. In other words, when the dent 30 is formed with the ratio between the height h2 and the width w2 as 1:5 to 30, the maximum stress caused by vibration in 3-axial directions may be reduced, and noise may be reduced, as shown in FIGS. 10 and 11.

However, when the height of the dent 30 is excessively small and the height-to-width ratio of the dent 30 deviates from the above-described ratio, the cross-sectional area reduction effect of the dent 30 may be insufficient. As a result, effects of stress reduction and noise reduction may be insufficient. On the other hand, when the height of the dent 30 is excessively large and the height-to-width ratio of the dent 30 deviates from the above-described ratio, the dent 30 rather interferes with flow of air and, as such, there may be a problem of an increase in noise.

Meanwhile, referring to FIG. 4, the runner 20 and the dent 30 may be formed with a ratio of the width w2 of the dent 30 to the width w1 of the runner 20 as 1:2.5 to 3. In addition, the runner 20 and the dent 30 may be formed with a ratio of the height h2 of the dent 30 to the height h1 of the runner 20 as 1:40 to 30. In particular, the dimension of the runner 20 with respect to the dent 30 may be applied to the uniformly-shaped dent portion 30*a* in the first section 20*a* (L1).

In other words, the width w1 of the runner 20 may be gradually increased from the plenum 10 toward the cylinder head 40, and the height h1 of the runner 20 may be gradually increased from the plenum 10 toward the cylinder head 40. As a result, the runner 20 has a structure in which the cross-sectional area thereof decreases gradually. For example, when the runner 20 has a width w1 of about 52 mm at a position near the plenum 10 when viewed with reference to the uniformly-shaped dent portion 30*a*, the runner 20 has a width w1 of about 57.6 mm at a position near the cylinder head 40.

In addition, when the runner 20 has a height h1 of about 40 mm at the position near the plenum 10, the runner 20 has a width w1 of about 32 mm at the position near the cylinder head 40. Thus, as the width w1 of the runner 20 increases gradually from the plenum 10 toward the cylinder head 40, and the height h1 of the runner 20 decreases gradually from the plenum 10 toward the cylinder head 40, the cross-section of the runner 20 has a gradually-reduced area while being varied to have a gradually-flattened quadrangular shape. Accordingly, the flow rate of air flowing along the runner 20 may further increase.

In addition, in accordance with the exemplary embodiment of the present disclosure, an outer surface of the runner 20 formed with the dent 30 may be formed to have a groove shape that corresponds to the shape of the dent 30. In other words, when an additional structure is attached to an inner surface of the runner 20 such that the inner surface of the runner 20 has a protruding structure, the weight of the intake manifold may increase due to the weight of the additional structure.

Accordingly, in accordance with the exemplary embodiment of the present disclosure, the outer surface of the runner 20 may be pressed inwards such that an inner surface of the runner 20 corresponding to the pressed portion of the runner 20 protrudes, thereby forming the dent 30. Accordingly, it may be possible to protrude the inner surface of the runner 20 without increasing the weight of the intake manifold. Thus, there may be advantages in terms of rigidity, stress and noise while reducing the weight of the intake manifold.

Figure 7:
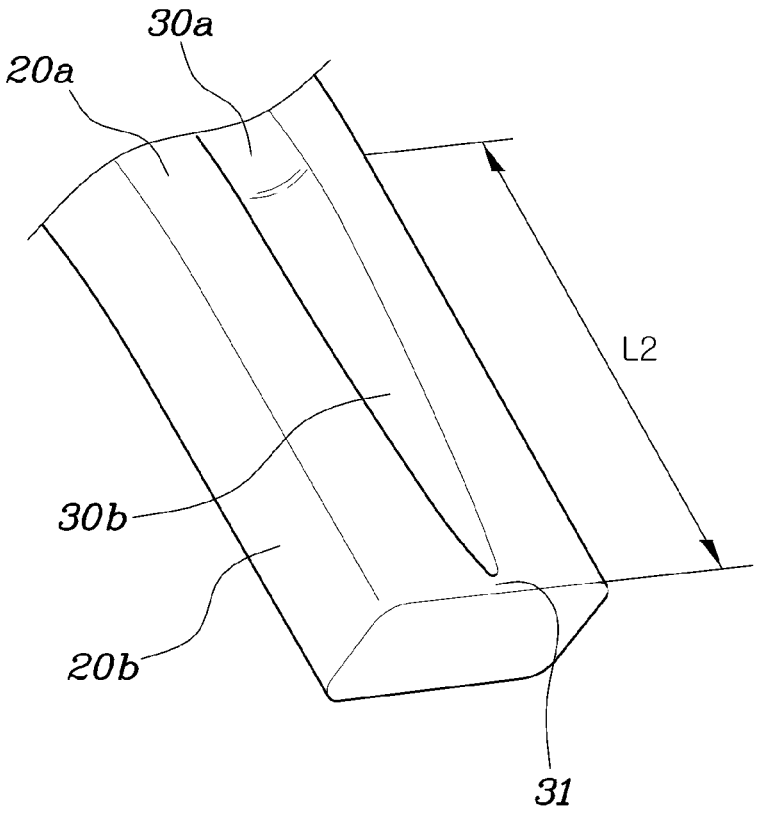
FIG. 7 is an enlarged view illustrating a dent portion formed at a second section of the runner according to an exemplary embodiment of the present disclosure.

Meanwhile, in accordance with the exemplary embodiment of the present disclosure, the protruding portion of the dent 30 may be formed to have a size that gradually decreases toward an end of the runner 20 in a predetermined section of the runner 20 including the end of the runner 20. In connection with this, configurations of the runner 20 and the dent 30 will be described in detail with reference to FIGS. 2 and 7. First, the runner 20 may be divided into a first section 20*a* and a second section 20*b*. The first section 20*a* may be formed to have a tubular structure with a curved shape having a predetermined curvature. The first section 20*a* may be a section connected to the outlet 12 of the plenum 10 at a first end of the first section 20*a*. The second section 20*b* may be formed to have a linear tubular shape. The second section 20*b* is a section joined to a second end of the first section 20*a* at a first end of the second section 20*b* while being connected to the corresponding port of the cylinder head 40 at a second end of the second section 20*b*.

Meanwhile, the dent 30 may be divided into a uniformly-shaped dent portion 30*a* and a variably-shaped dent portion 30*b* in accordance with formation positions and shapes thereof. The uniformly-shaped dent portion 30*a* may be formed along an inner surface of the first section 20*a* to have a uniform cross-section with a predetermined shape. The variably-shaped dent portion 30*b* may be formed along an inner surface of the second section 20*b*. A first end of the variably-shaped dent portion 30*b* may be formed to have a shape matched with the cross-section of the uniformly-shaped dent portion 30*a*, and may be connected to the uniformly-shaped dent portion 30*a*. The variably-shaped dent portion 30*b* has a structure having a cross-section gradually decreasing toward a second end of the variably-shaped dent portion 30*b*.

A flat surface 31 may be formed between the second end of the runner 20 and the second end of the variably-shaped dent portion 30*b*. In other words, as the dent 30 is gradually reduced from a point spaced apart from the corresponding port of the cylinder head 40 by a predetermined distance, and the inner surface of the end of the runner 30 connected to the port is flat, air may be introduced into the cylinder under the condition that flow of air is more stably achieved in a portion of the runner 20 joined to the port.

Figure 2:
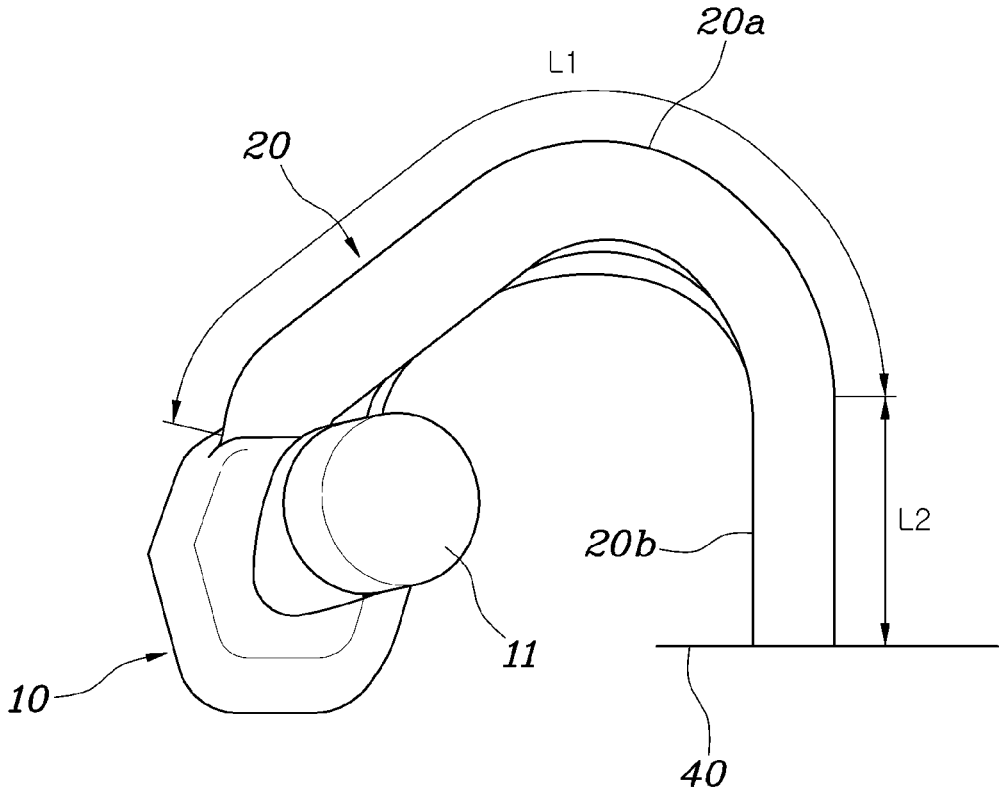
FIG. 2 is a side view corresponding to FIG. 1 according to an exemplary embodiment of the present disclosure.

In addition, referring to FIG. 2, the length of the first section 20*a*, that is, a length L1, and the length of the second section 20*b*, that is, a length L2, with reference to the channel of the runner 20 may be determined to have a length ratio of 3.1 to 3.3:1. The lengths L1 and L2 of the first section 20*a* and the second section 20*b* are lengths along a virtual line that extends along a center line of the channel of the runner 20. When the length L1 of the first section 20*a* is about 290 mm, the length L2 of the second section 20*b* may be determined to be about 90 mm.

Figure 8:
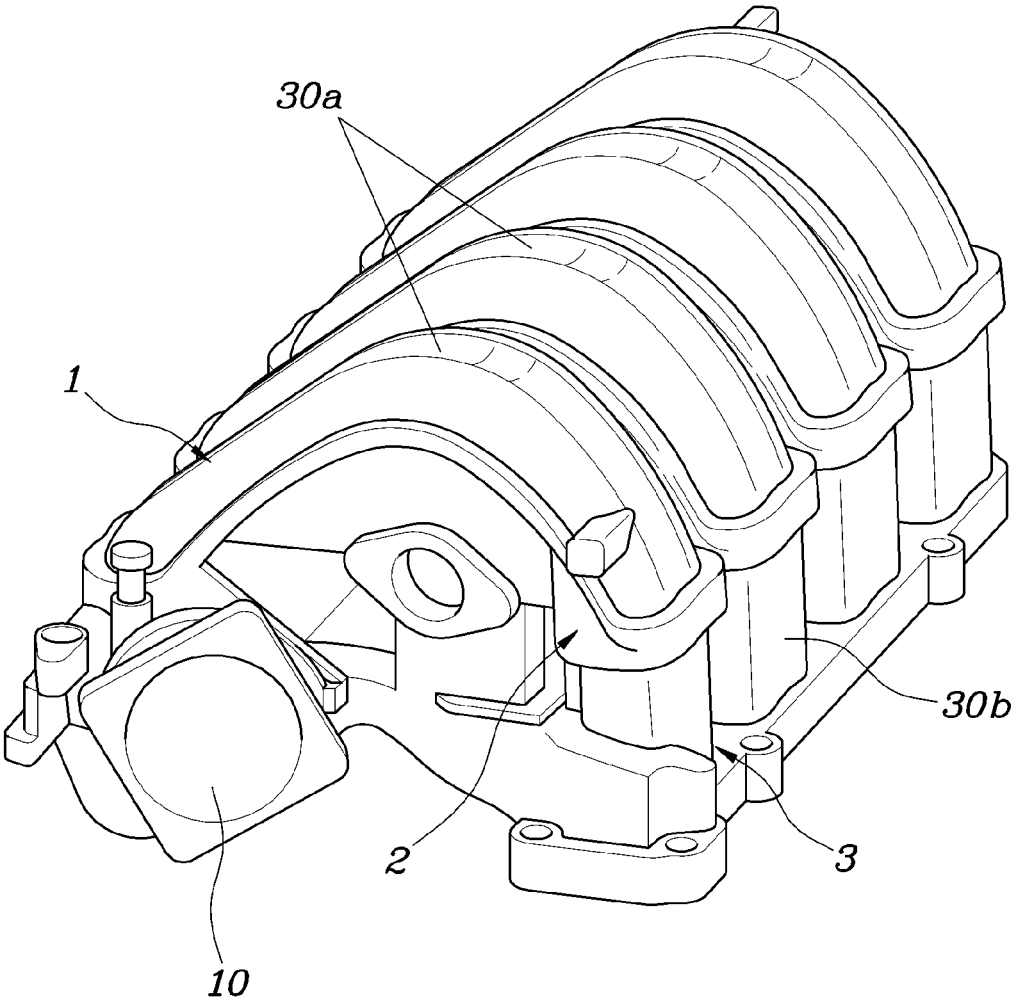
FIG. 8 is a view illustrating a shape of the intake manifold according to an exemplary embodiment of the present disclosure.
Figure 9:
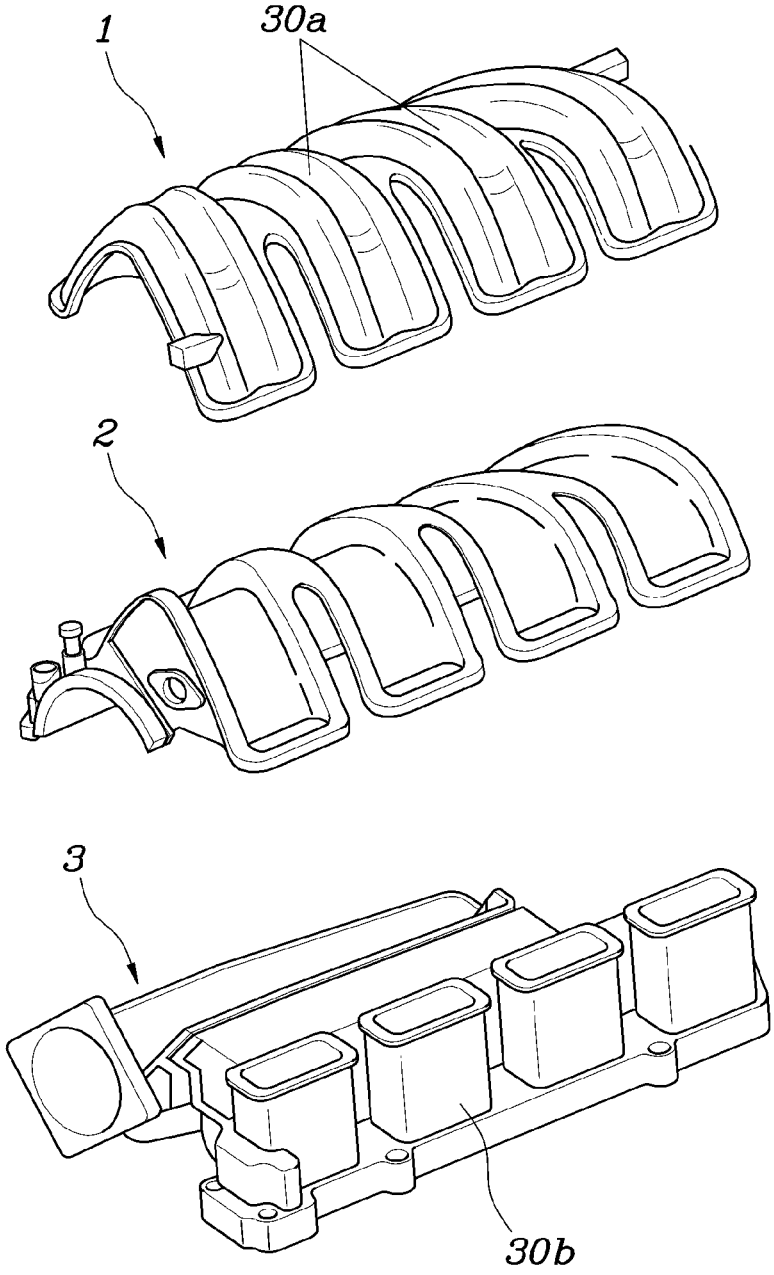
FIG. 9 is an exploded view of elements to be assembled to complete the intake manifold according to the exemplary embodiment of the present disclosure.

Meanwhile, referring to FIGS. 8 and 9, the intake manifold according to the exemplary embodiment of the present disclosure is completed through assembly of an upper shell 1, a center shell 2, and a lower shell 3. In particular, the upper shell 1 may be assembled to an upper end of the center shell 2 to embody the first section 20*a* of each runner 20, and the lower shell 3 may be assembled to a lower end of the center shell 2 to embody the second section 20*b* of each runner 20.

In addition, the uniformly-shaped dent portion 30*a* of each dent 30 may be formed along a concave inner surface of the upper shell 1, and the variably-shaped dent portion 30*b* of each dent 30 may be formed along an inner surface of the lower shell 3 assembled to the upper shell 1 at a position joined to the uniformly-shaped dent portion 30*a* of the dent 30. In other words, the upper shell 1 and the lower shell 3 may be assembled to the upper and lower ends of the center shell 2, respectively, and, as such, the runners 20 and the plenum 10 may be formed.

Figure 3:
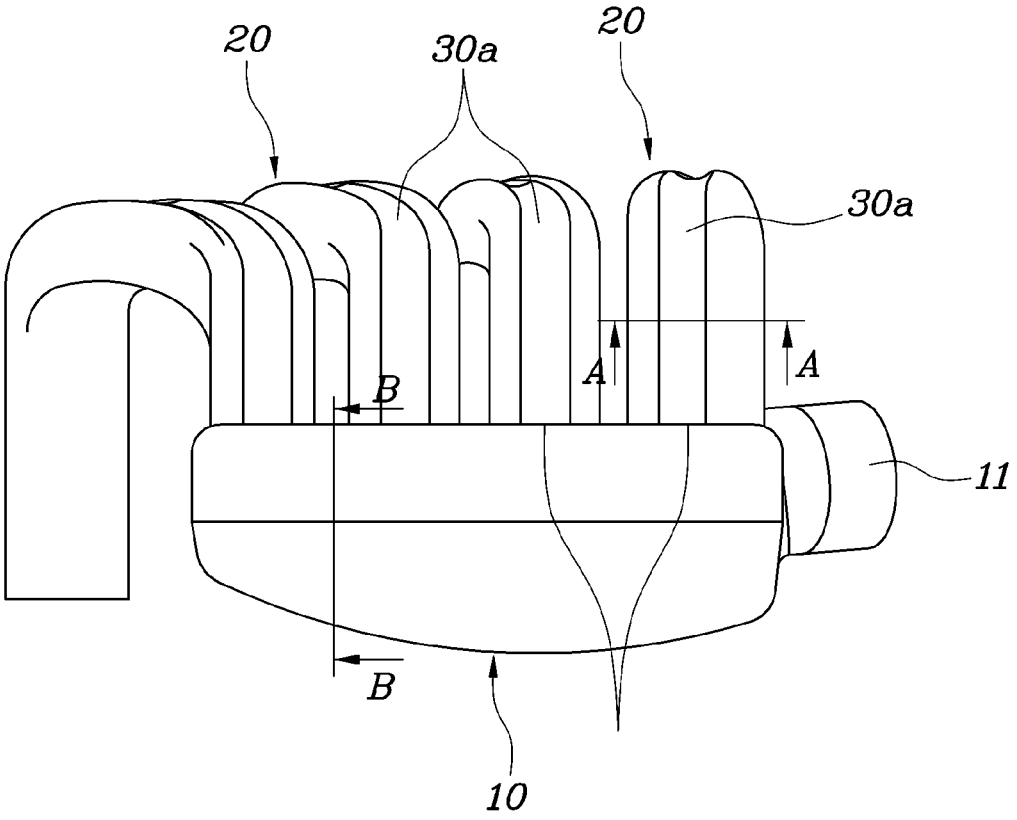
FIG. 3 is a rear view corresponding to FIG. 1 according to an exemplary embodiment of the present disclosure.
Figure 6:
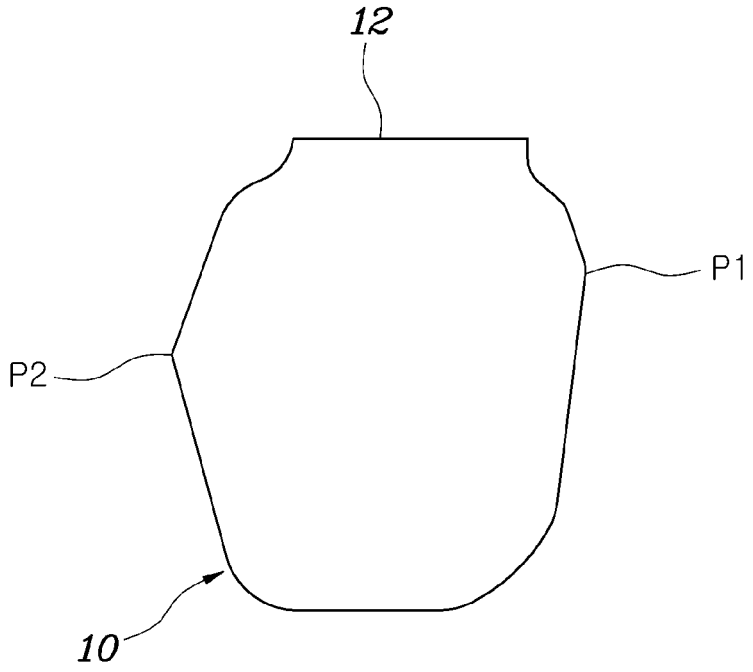
FIG. 6 is a cross-sectional view taken along line B-B' in FIG. 3, illustrating a cross-sectional shape of a plenum according to an exemplary embodiment of the present disclosure.

Meanwhile, referring to FIGS. 3 and 6, the runners 20 may be connected to an upper surface of the plenum 10 while being arranged in a longitudinal direction of the upper surface of the plenum 10. The plenum 10 may be formed to have an expanded structure in which opposite lateral surfaces of the plenum 10 protrude outwards at middle portions thereof, respectively. When opposite lateral surfaces of the plenum 10 are formed to have a vertically flat shape, an inner surface of the plenum 10 may function as a boom plate and, as such, noise may be generated. In accordance with the exemplary embodiment of the present disclosure, opposite lateral surfaces of the plenum 10 expand outwards at central points P1 and P2 thereof, respectively, such that each lateral surface has a bent shape. Accordingly, noise may be reduced.

In addition, referring to FIG. 3, in accordance with the exemplary embodiment of the present disclosure, an inlet 11 may be formed at a first end of the plenum 10. In particular, the plenum 10 may be formed to have a cross-sectional area that gradually increases as the plenum 10 extends from a first end thereof to a middle portion thereof in a longitudinal direction while gradually decreasing as the plenum 10 extends from the middle portion thereof to a second end thereof in the longitudinal direction. The cross-sectional area at the second end of the plenum 10 may be less than the cross-sectional area at the first end of the plenum 10. In other words, since the plenum 10 has a cross-sectional area gradually decreasing from the middle portion thereof toward the second end thereof, the flow rate of air introduced into the plenum 10 through the inlet 11 may be increased. Accordingly, air may stably flow from the first end of the plenum 10 to the second end of the plenum 10.

Meanwhile, the present disclosure may be applied to the structure of the runners 20 of the intake manifold. In connection with this, the structure of each runner 20 according to the exemplary embodiment of the present disclosure will be described. The runner 20 may be connected between the plenum 10 and the cylinder head 40 to guide air introduced into the plenum 10 by the runner 20 to enter the cylinder head 40. The dent 30 may be formed at the runner 20 such that the dent 30 has a protruding inner surface that extends in a longitudinal direction of the runner 20.

The dent 30 is not formed at the second end of the runner 20 such that the runner 20 has a flat inner surface at the second end thereof. The flat inner surface of the runner 20 may be connected to the cylinder head 40. In other words, an increase in intrinsic frequency may be achieved by the dent 30 formed at the runner 20 and, as such, an increase in rigidity of the intake manifold is achieved. In addition, the maximum stress exhibited in accordance with vibration in 3-axial directions (X-axis, Y-axis, and Z-axis) may be reduced, and noise may be reduced.

FIG. 10 show experimental results of stress variation exhibited in accordance with frequency variation in an example in which the dent 30 is formed in accordance with the exemplary embodiment of the present disclosure and a comparative example in which there is no dent 30. The experimental results are results exhibited when 1 g vibration is performed in X-axis, Y-axis, and Z-axis directions. Referring to FIG. 10, at maximum stress in the X-axis direction, 5.4 MPa is detected in the comparative example, and 3.8 MPa is detected in the example of the present disclosure. Accordingly, the example of the present disclosure achieves an improvement of about 29.6%, as compared to the comparative example.

In addition, at maximum stress in the Y-axis direction, 3.1 MPa is detected in the comparative example, and 1.7 MPa is detected in the example of the present disclosure. Accordingly, the example of the present disclosure achieves an improvement of about 45.1%, as compared to the comparative example. Further, at maximum stress in the Z-axis direction, 8.3 MPa is detected in the comparative example, and 5.4 MPa is detected in the example of the present disclosure. Accordingly, the example of the present disclosure achieves an improvement of about 34.9%, as compared to the comparative example. In other words, since the dent 30 is formed at the inner surface of the runner 20, the maximum stress according to 3-axial vibration may be substantially reduced and, as such, rigidity and durability performance may be enhanced.

FIG. 11 show experimental results of noise variation exhibited in accordance with frequency variation in the example in which the dent 30 is formed in accordance with the exemplary embodiment of the present disclosure and the comparative example in which there is no dent 30. Referring to FIG. 11, for a root mean square (RMS) value as average noise in a range lower than 2,000 Hz, 53.6 dB is measured in the comparative example, and 47.3 dB is measured in the example of the present disclosure. Accordingly, the example of the present disclosure achieves an improvement of about 11.7%, as compared to the comparative example.

In addition, for an RMS value as average noise in a range lower than 5,000 Hz, 87.7 dB is measured in the comparative example, and 83.9 dB is measured in the example of the present disclosure. Accordingly, the example of the present disclosure achieves an improvement of about 4.3%, as compared to the comparative example. In other words, since the dent 30 is formed at the inner surface of the runner 20, a substantial enhancement in nose reduction effect is achieved.

As apparent from the above description, the dent 30 may be formed to have a protruding structure at the inner surface of the runner 20 in accordance with the exemplary embodiment of the present disclosure and therefore, flow rate of air passing through the runner 20 may be increased. Accordingly, an enhancement in response characteristics of a vehicle, to which the runner structure according to the exemplary embodiment of the present disclosure is applied, may be achieved. In particular, an increase in intrinsic frequency may be achieved by the dent 30 and, as such, an increase in rigidity of the intake manifold may be achieved. In addition, the maximum stress exhibited in accordance with vibration in 3-axial directions (X-axis, Y-axis, and Z-axis) may be reduced, and noise may be reduced.

Although the exemplary embodiments of the present disclosure have been disclosed for illustrative purposes, those skilled in the art will appreciate that various modifications, additions and substitutions are possible, without departing from the scope and spirit of the disclosure as disclosed in the accompanying claims.

What is claimed is:

1. An intake manifold, comprising:

a runner connected between a plenum and a cylinder head, wherein air is introduced into the plenum to enter the cylinder head; and a dent formed at the runner, wherein the dent extends along a channel of the runner while having an inner surface with a protruding shape, wherein the runner includes at a first end thereof, an inner surface formed to be flat without being formed with the dent, and the inner surface of the runner is connected to the cylinder head, wherein the runner includes:

a first section formed to have a tubular structure with a curved shape having a predetermined curvature, and connected to an outlet of the plenum at a first end thereof, and a second section formed to have a linear tubular shape, and joined to a second end of the first section at a first end thereof while being connected to a port of the cylinder head at a second end thereof, and wherein the dent includes:

a uniformly-shaped dent portion formed along an inner surface of the first section to have a uniform cross-section with a predetermined shape, and a variably-shaped dent portion formed along an inner surface of the second section, and connected to the uniformly-shaped dent portion.

2. The intake manifold according to claim 1, wherein:

the runner is formed to have a shape bent in a longitudinal direction thereof to have a predetermined curvature at an intermediate portion thereof; and the dent is formed along an inner surface of the runner directed outwards with reference to the channel of the runner.

3. The intake manifold according to claim 1, wherein:

the runner is formed to have a quadrangular tube structure with a closed cross-sectional shape;

the runner has a cross-sectional area that gradually decreases as the runner extends from the first end thereof joined to the plenum to a second end thereof joined to the cylinder head; and the dent is centrally formed at an inner surface of the runner disposed at one side of an overall peripheral inner surface of the runner forming a tubular shape of the runner.

4. The intake manifold according to claim 1, wherein:

the runner is formed to have a rectangular tube shape in which a lateral width thereof is greater than a vertical height thereof; and the dent is formed with a lateral width greater than a vertical height thereof, and is formed at one inner surface of the runner extending laterally to have the lateral width.

5. The intake manifold according to claim 1, wherein a height of the dent and a width of the dent have a length ratio of 1:5 to 30.

6. The intake manifold according to claim 1, wherein a width of the dent and a width of the runner have a ratio of 1:2.5 to 3; and a height of the dent and a height of the runner have a ratio of 1:40 to 30.

7. The intake manifold according to claim 1, wherein an outer surface of the runner formed with the dent is formed to have a groove shape that corresponds to a shape of the dent.

8. The intake manifold according to claim 1, wherein the dent is formed with the protruding shape thereof gradually decreasing toward the end of the runner in a predetermined section of the runner including the end of the runner.

9. The intake manifold according to claim 1, wherein a first end of the variably-shaped dent portion is formed to have a shape matched with a cross-section of the uniformly-shaped dent portion, and is connected to the uniformly-shaped dent portion, and the variably-shaped dent portion has a structure having a cross-section gradually decreasing toward a second end of the variably-shaped dent portion.

10. The intake manifold according to claim 1, wherein a flat surface is formed between the second end of the runner and a second end of the variably-shaped dent portion.

11. The intake manifold according to claim 1, wherein a length of the first section and a length of the second section with reference to the channel of the runner have a length ratio of 3.1 to 3.3:1.

12. The intake manifold according to claim 1, wherein:

the intake manifold is completed through assembly of an upper shell, a center shell, and a lower shell;

the upper shell is assembled to an upper end of the center shell to form the first section of the runner;

the lower shell is assembled to a lower end of the center shell to form the second section of the runner;

the uniformly-shaped dent portion of the dent is formed along a concave inner surface of the upper shell; and the variably-shaped dent portion of the dent is formed along an inner surface of the lower shell assembled to the upper shell at a position joined to the uniformly-shaped dent portion of the dent.

13. The intake manifold according to claim 1, wherein:

the runner is connected to an upper surface of the plenum while being arranged in a longitudinal direction of the upper surface of the plenum; and the plenum is formed to have an expanded structure in which opposite lateral surfaces of the plenum protrude outwards at middle portions thereof, respectively.

14. The intake manifold according to claim 1, wherein:

an inlet is formed at a first end of the plenum;

the plenum is formed to have a cross-sectional area gradually increasing as the plenum extends from the first end thereof to a middle portion thereof in a longitudinal direction; and the plenum is formed to have a cross-sectional area gradually decreasing as the plenum extends from the middle portion thereof to a second end thereof in the longitudinal direction and the plenum has a smaller cross-sectional area at the second end thereof than at the first end thereof.

15. A runner structure for an intake manifold wherein:

the runner structure is connected between a plenum and a cylinder head and air is introduced into the plenum to enter the cylinder head;

a dent formed at the runner structure and the dent extends in a longitudinal direction of the runner structure while having an inner surface with a protruding shape; and the runner structure has, at an end thereof, an inner surface formed to be flat without being formed with the dent, and the inner surface of the runner structure is connected to the cylinder head, wherein the runner includes:

a first section formed to have a tubular structure with a curved shape having a predetermined curvature, and connected to an outlet of the plenum at a first end thereof, and a second section formed to have a linear tubular shape, and joined to a second end of the first section at a first end thereof while being connected to a port of the cylinder head at a second end thereof, and wherein the dent includes:

a uniformly-shaped dent portion formed along an inner surface of the first section to have a uniform cross-section with a predetermined shape, and a variably-shaped dent portion formed along an inner surface of the second section, and connected to the uniformly-shaped dent portion.

* * * * *